US007000343B1

(12) United States Patent
Teichman

(10) Patent No.: US 7,000,343 B1
(45) Date of Patent: Feb. 21, 2006

(54) FLEXIBLE PLATEN IMAGE DISPLAY DEVICE AND METHOD

(76) Inventor: Terrence J. Teichman, 13645 S. Maple Ave., Lemont, IL (US) 60439

( * ) Notice: Subject to any disclaimer, the term of this patent is extended or adjusted under 35 U.S.C. 154(b) by 182 days.

(21) Appl. No.: 10/123,375

(22) Filed: Apr. 16, 2002

(51) Int. Cl.
*G09F 11/00* (2006.01)

(52) U.S. Cl. ..... 40/436; 40/476

(58) Field of Classification Search ..... 40/436, 40/437, 470, 476
See application file for complete search history.

(56) References Cited

U.S. PATENT DOCUMENTS 3,862,504 A * 1/1975 Ringelheim et al. ..... 40/437
3,918,185 A * 11/1975 Hasala ..... 40/436
4,034,555 A 7/1977 Rosenthal ..... 58/127 R
4,118,879 A 10/1978 Simon ..... 40/437
5,113,213 A 5/1992 Sandor et al. ..... 355/22
5,459,954 A * 10/1995 Bronaugh et al. ..... 40/476
5,513,458 A * 5/1996 Dehli ..... 40/470
5,644,431 A 7/1997 Magee ..... 359/619
5,657,565 A 8/1997 Dehli ..... 40/476
6,748,684 B1 * 6/2004 Bar-Yona ..... 40/454

* cited by examiner

*Primary Examiner*—Cassandra Davis
(74) *Attorney, Agent, or Firm*—Eugene F. Friedman

(57) ABSTRACT

A multi-image display device has an arcuate platen formed by mounting a transparent flexible sheet in compression to a frame. The platen is convex or otherwise bow-shaped. Associated with the platen are a translucent image sheet having a plurality of images thereon and a restricting layer having transparent and opaque portions associated with the image sheet to permit viewing of those portions of the image sheet that register with the transparent portions of the restricting layer. Suitably altering the alignment of the image sheet relative to the restrictive layer (or vice versa) changes the image that is displayed.

34 Claims, 4 Drawing Sheets

FLEXIBLE PLATEN IMAGE DISPLAY DEVICE AND METHOD

FIELD OF THE INVENTION

This invention relates to a multi-image display device and more particularly, to an improved platen design for a multi-image display device.

BACKGROUND OF THE INVENTION

Multi-image display devices are known in the art. These devices are useful in providing vivid multi-image or animated advertisements designed to capture a potential customer's attention. Typically, such devices have an arcuate transparent platen with a translucent interleaved image sheet mounted thereon. A restricting layer prevents the backlighting from illuminating certain areas of the image sheet. The image displayed changes as the restricting layer is moved in front of the interleaved image. For instance, U.S. Pat. No. 4,118,879, the disclosure of which is incorporated by reference, teaches that the arcuate platen is necessary to maintain full surface contact between the mounted image sheet and the moveable restricting layer. This continuous contact avoids parallax and enables the projection of multiple, high-resolution images.

Despite the appeal of these advertising displays, conventional methods for platen production are disadvantageous for a number of reasons. The platen is a rigid transparent polymer formed either by injection or extrusion molding processes. Economic considerations of conventional molding processes tend to limit the size of the display device to relatively small sizes, such as less than two feet by three feet. Moreover, when a different size or shape is desired for the display, the platen mold must be re-tooled—an expensive and time consuming endeavor. This is particularly troublesome in an industry where advertisers must oftentimes react promptly to customer demands, unforeseen events dictated by the competitive landscape and fickle consumer trends in order to successfully exploit a promotional opportunity.

A need exists for an image display device that can be readily and economically produced in a desired size and shape. A need further exists for an economical device capable of displaying large multiple images, such as larger than two feet by three feet, for example.

SUMMARY OF THE INVENTION

In accordance with the present invention, an image display device is provided in which a flexible transparent sheet is mounted, preferably in compression, onto a frame in such a manner to form a convex platen, which typically will be bow-shaped or arcuate-shaped. Associated with the platen are a flexible image sheet having translucent images thereon and a restricting layer or sheet with transparent and opaque (typically black) portions in registration with the images on the image sheet. Altering the alignment of the image sheet in a desired manner relative to the restricting layer (or vice versa) changes the image that is displayed.

In accordance with another aspect of the invention, the transparent flexible sheet is normally flat when not mounted. Suitable mounting structure on the non-viewing margin of the transparent flexible sheet enables the sheet to be mounted in compression or otherwise in a desired outwardly curved or bowed configuration to the frame thereby causing the flexible sheet to bow outwardly and achieve the desired arcuate or bow-shape.

In accordance with another aspect of the invention, the transparent flexible sheet is mounted on a curved frame. More specifically, the curved frame is located in contact with and adjacent to non-viewing margin areas of the transparent flexible sheet to form the desired arcuately shaped platen.

In accordance with another aspect of the invention, the frame, platen, image sheet and restricting layer are contained in a first housing. This housing also provides an illumination source that backlights the image.

In accordance with another aspect of the invention, the illumination source is located in a second housing. The second housing contains the first housing. Thus, the first housing can be a modular construction to permit retrofitting of the first housing to an existing second housing, which can be an existing lightbox.

In accordance with another aspect of the present invention, the restricting layer is mounted in tensioned contact with the image sheet. A drive mechanism moves the restricting layer relative to the image sheet thereby changing the image displayed by the device. Alternatively, the image sheet can be moved relative to the restricting layer.

In accordance with another aspect of the present invention, a method is provided for forming an arcuate transparent platen in an animated display device which includes a frame, comprising obtaining a flexible sheet of transparent material and mounting the flexible sheet to form an arcuate platen.

In accordance with another aspect of the invention, the image sheet is incorporated or integrated into the platen. Thus, the flexible, bowed or arcuate-shaped platen can also include or comprise the image sheet. Typically, the restricting layer is placed in tensioned contact with the platen. A drive mechanism moves the restricting layer and the platen relative to each other thereby changing the image displayed by the device.

In accordance with another aspect of the invention, the restricting layer is incorporated or integrated into the platen. Thus, the flexible bowed or arcuate-shaped platen can also include or comprise the restricting layer. Typically, the image sheet is placed in tensioned contact with the platen. A drive mechanism is provided to move the image sheet and the platen relative to each other to thereby change the image displayed by the device.

In accordance with another aspect of the invention, a registration or indicia strip is provided perpendicular to the direction of movement and typically on the upper and/or lower edge of the image sheet and parallel to the image lines. The registration or indicia may comprise a plurality of straight, thin different color or contrasting lines or that otherwise have a visually distinguishing feature, extending normal to the direction of movement, so that the lines are horizontal for an image that is moved vertically to display alternating images. Alignment between the interleaved images of the image sheet and the restricting layer occurs by adjusting the alignment, typically the horizontal alignment, of the restricting layer relative to the image sheet. Proper registration is obtained between the restricting layer and image sheet when the registration strip displays a series of parallel horizontal lines of only one color. For very precise alignment, the registration indicia comprises slightly spaced apart lines of different color or contrast that are the same or slightly thicker (such as about one percent thicker) than the transparent sections of the restricting layer. A plurality of repeating alternating colors can be provided on the image sheet so that when proper alignment is achieved, the plurality of bands of a single color are visible in that number of adjacent spaced apart transparent bands on the restricting layer, thereby providing a more readily observable color band to the person adjusting the relative orientation of the image of that layer or sheet to the restricting layer or sheet.

DETAILED DESCRIPTION OF THE INVENTION

Figure 1:
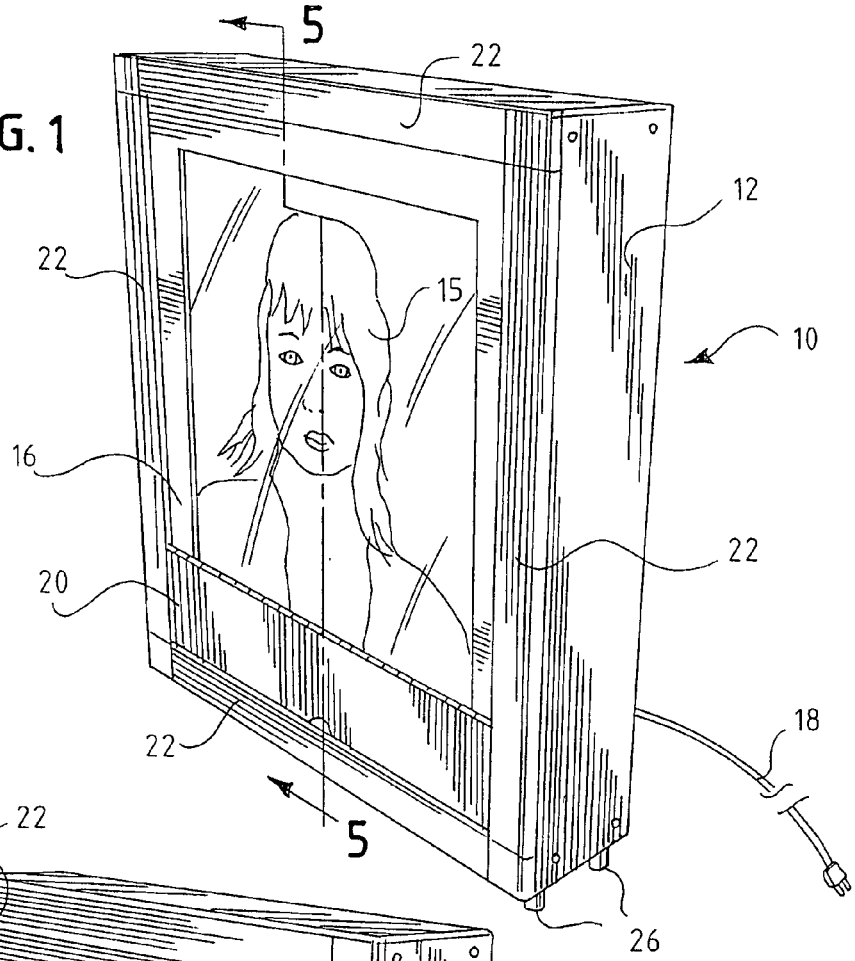
FIG. 1 is a perspective view of an image display device in accordance with the present invention.
Figure 2:
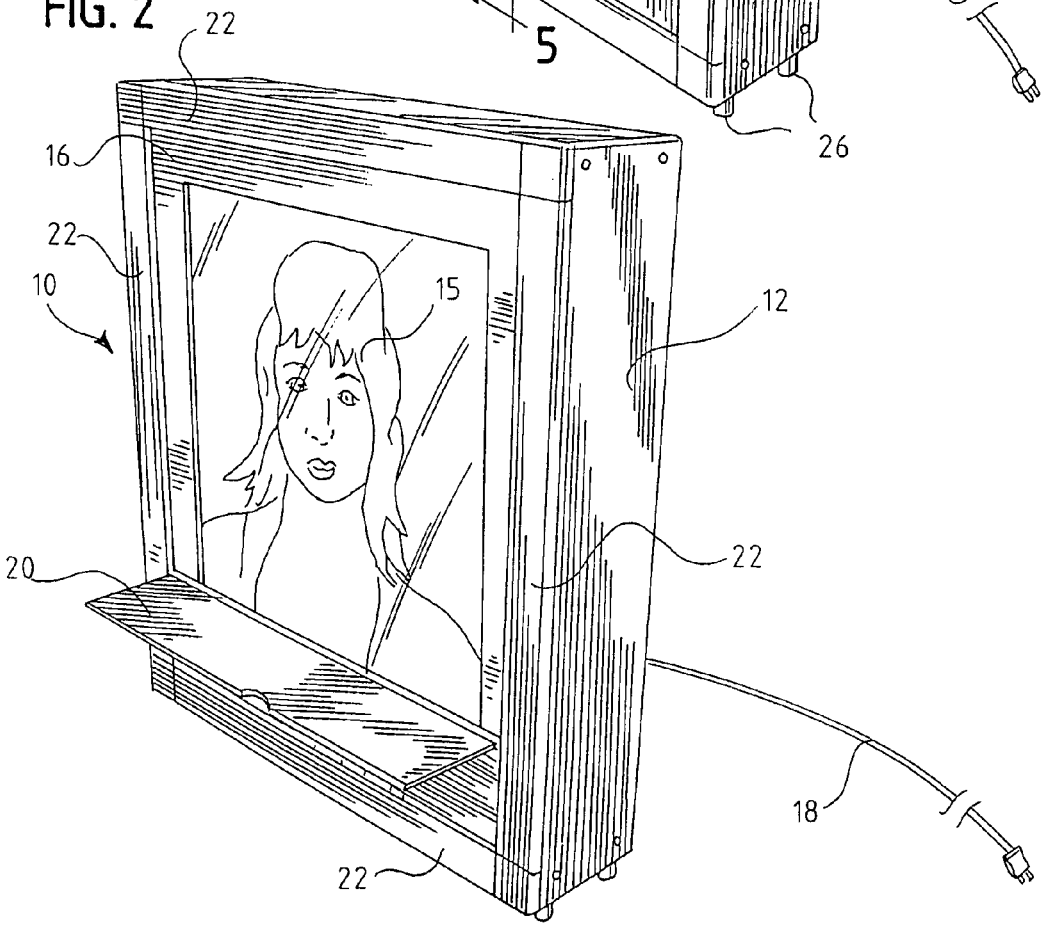
FIG. 2 is a perspective view of the image display device of FIG. 1 showing an access panel opened.

Referring to the Figures generally, where like reference numerals denote like structure and elements, and in particular to FIGS. 1 and 2, an animated display device 10 in accordance with the invention is depicted comprising a housing 12 having flaps 22, a module 14 displaying an image of a woman 15 and a frame 16. Electrical cord 18 provides electrical power to the components within housing 12, which will be explained more fully below. Alternatively, device 10 may be battery powered. Frame 16 covers the inner components of module 14 and provides an aesthetically attractive border finish for the image viewing face of device 10. Frame 16 also comprises hinged panel 20. Feet 26 provide support to enable device 10 to stand upright on substantially horizontal surfaces. Housing 12 may also be suitably adapted to be suspended for elevated image display. Similarly, housing 12 may be further adapted to rotate.

Figure 3:
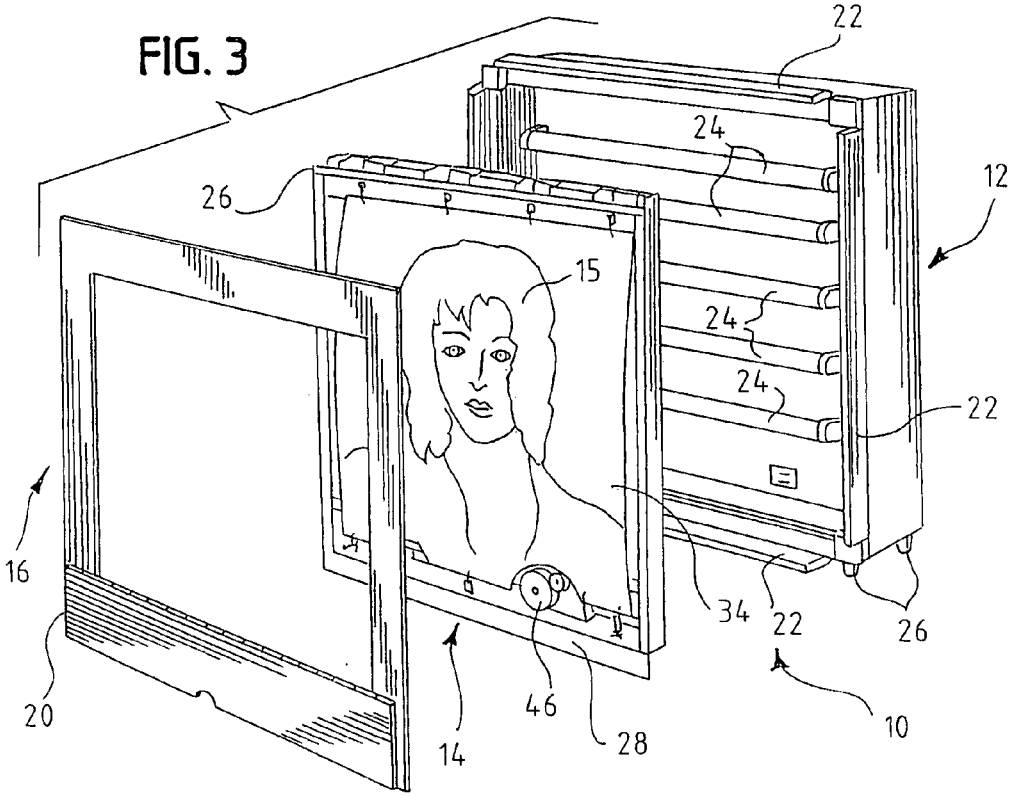
FIG. 3 is an exploded perspective view of the image display device of FIG. 1.

The exploded view of FIG. 3 shows that when flaps 22 are opened, module 14 and frame 16 can be readily removed from housing 12. This allows for easy maintenance and convenient replacement of the internal components within device 10. Also included in housing 12 is illumination source 24. The skilled artisan will readily recognize that any suitable illumination source may be used in accordance with the present invention including, but not limited to, fluorescent, incandescent, any suitable colored light source as may be applicable for a particular application, including black lighting, and halogen.

Figure 4:
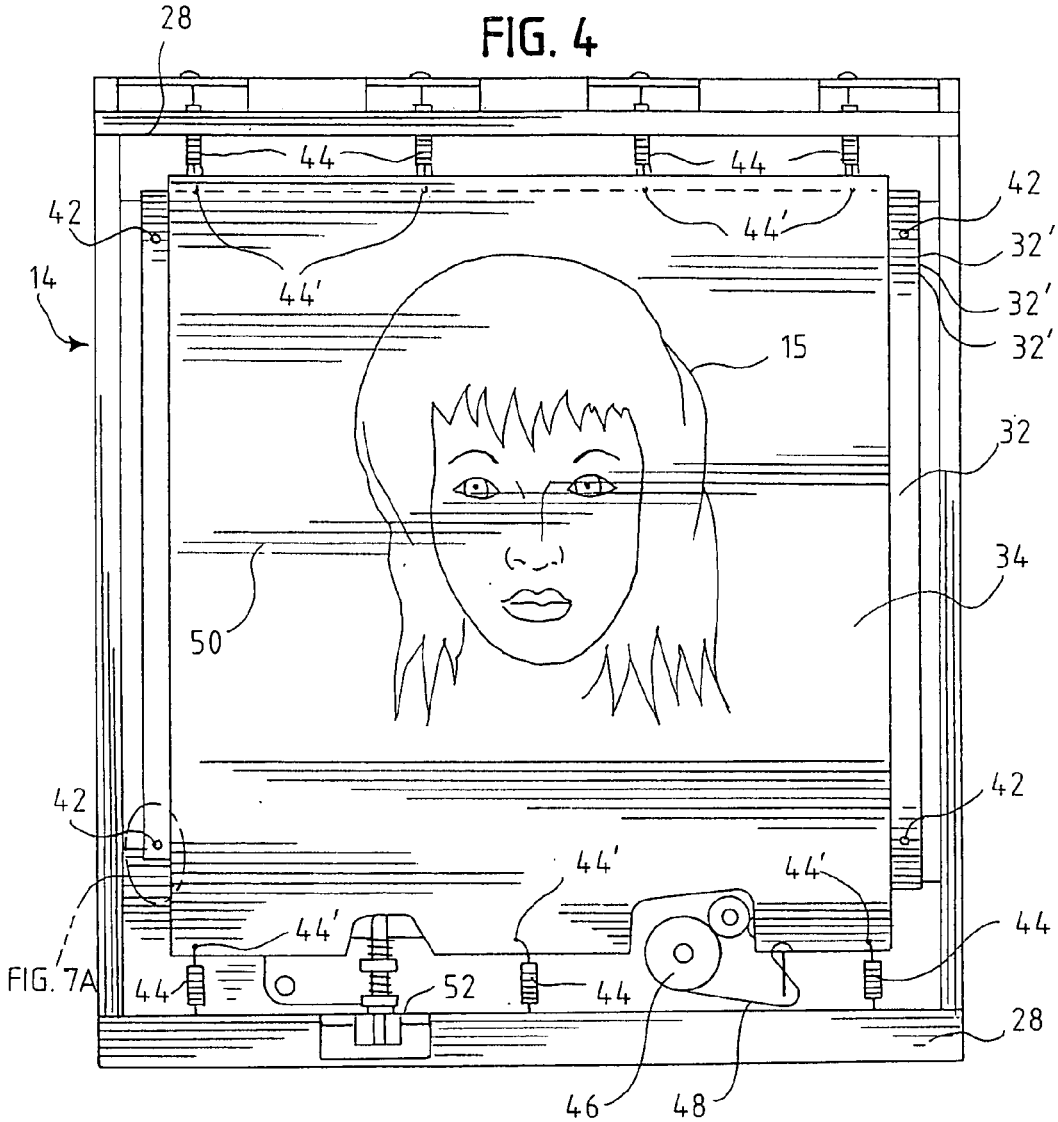
FIG. 4 is a front elevation view of the image display device of FIG. 1.
Figure 5:
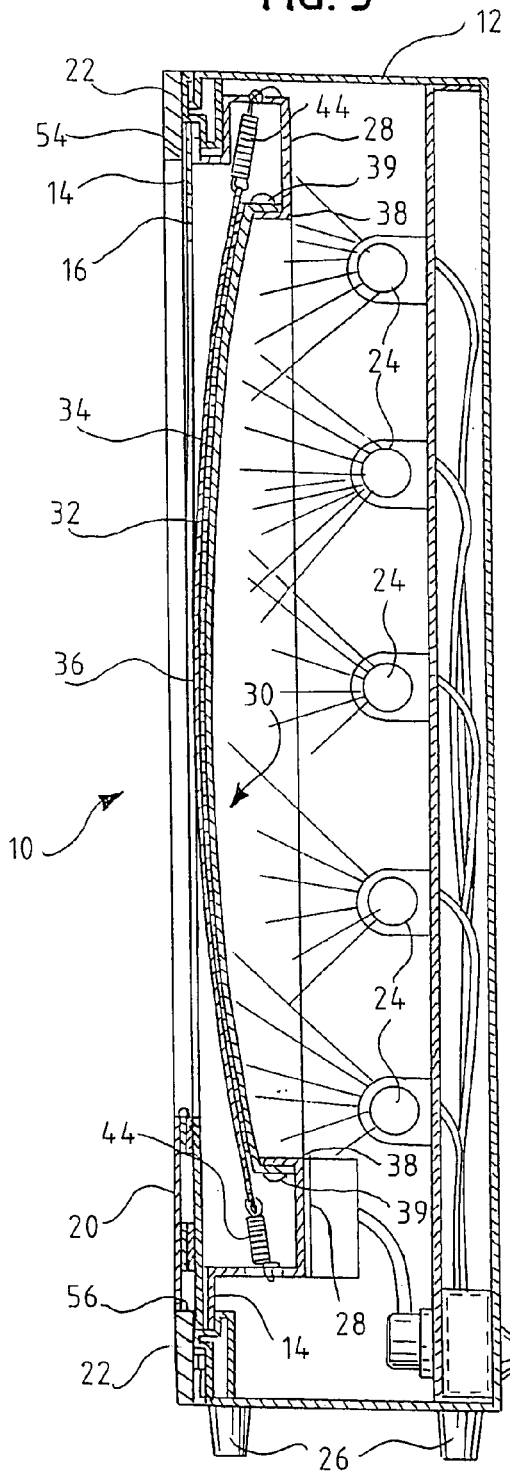
FIG. 5 is a sectional view of the image display device along line 5—5 of FIG. 1.

FIGS. 4 and 5 (FIG. 5 is a sectional view of device 10 along line 1—1 of FIG. 1) show module 14 having a frame 28, a flexible transparent sheet 36 forming arcuate platen 30, a flexible image sheet 32, and a restricting layer 34. Frame 28 may be made of any suitable material including, but not limited to metal, plastic, wood or combinations thereof.

Figure 6A:
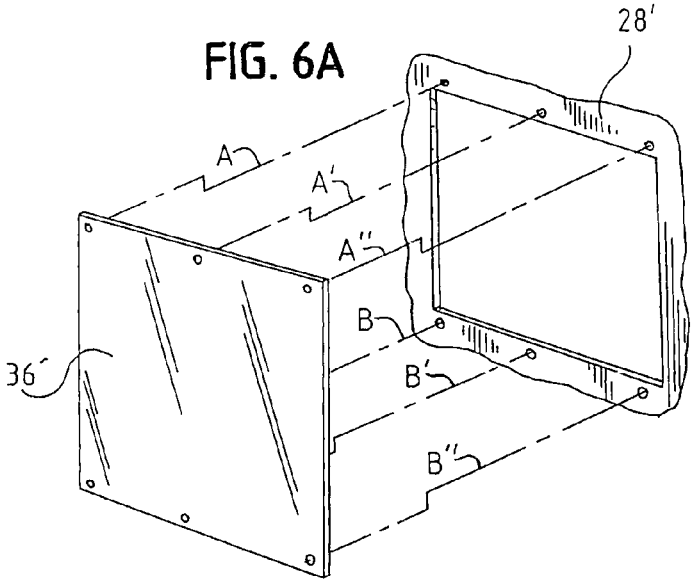
FIG. 6A is a perspective exploded view of one platen embodiment in accordance with the present invention.
Figure 6B:
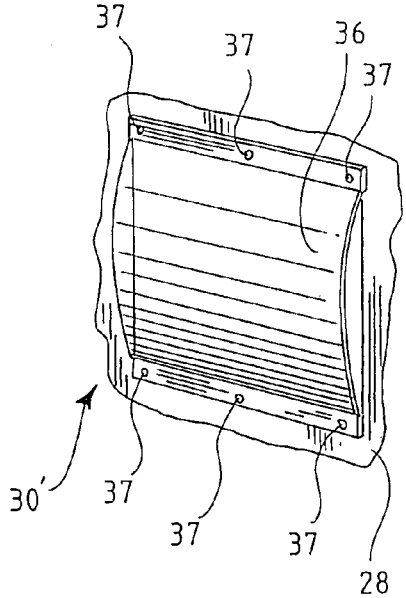
FIG. 6B is a perspective view of the platen embodiment of FIG. 6A.

As shown in FIGS. 6A and 6B, transparent flexible sheet 36' is used to form arcuate platen 30'. Preferably, flexible sheet 36' is initially flat. Lines A, A', A" and B, B', B" illustrate that the distance between the opposing mounting surfaces of frame 28' is shorter than the length between the corresponding opposing mounting edges of sheet 36'. Consequently, sheet 36' is mounted in compression (as opposed to being in tension) as it is secured to frame 28' with bolts 37. This compression mounting makes sheet 36' bow outward in a convex manner to form transparent arcuate platen 30' as shown in FIG. 6B. The skilled artisan will realize that the degree or magnitude of the platen arc can be varied by simply altering the distance between the mounting surfaces of frame 28', using different sizes of flexible transparent material for sheet 36' or applying combinations thereof as desired. Any suitable structure may be used to secure sheet 36' to frame 28' including, but not limited, to screws, bolts, rivets, glue or other adhesive material, a male-female slot arrangement or a latched configuration.

Formation of platen 30' in this manner significantly reduces the costs associated with the production of animated display devices by eliminating the need for conventional rigid, molded platens. As the limitations of rigid platens are eliminated, the present invention is particularly suited for the production of large image display devices—devices displaying images four feet by eight feet or larger. Sheet 36' may be any suitable flexible transparent material as is commonly known to those skilled in the art including, but not limited to, acrylic resins and other flexible transparent polymers. Preferably, sheet 36' is made from a flexible sheet of acrylic resin.

Returning to FIG. 5, another embodiment of platen 30 is depicted. Perpendicular flanges 38 are formed at the periphery of flexible transparent sheet 36. Flanges 38 are secured to frame 28 by screws 39 as described above to form arcuate platen 30.

Figure 6C:
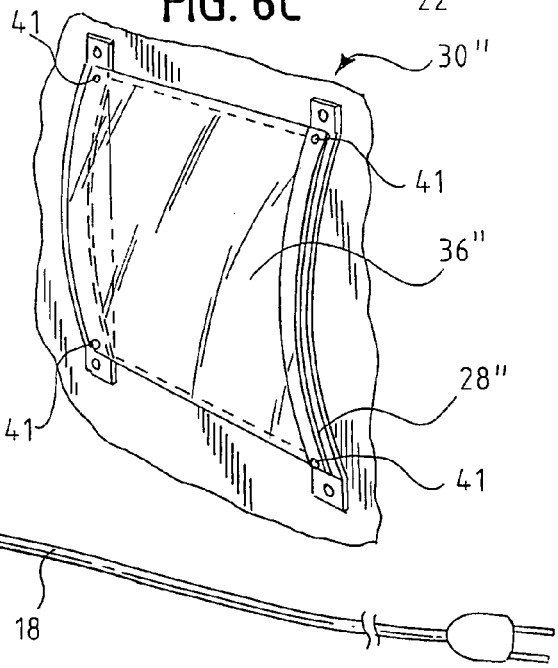
FIG. 6C is a perspective view of another platen embodiment in accordance with the present invention.

Similarly, FIG. 6C shows another embodiment of the present invention wherein flexible transparent sheet 36" is secured to curved frame 28" by rivets 41. Flexible transparent sheet 36" conforms to the curvature of curved frame 28" to form arcuate platen 30". Curved frame 28" can be suitably adapted to support any degree of curvature as desired. The skilled artisan will appreciate that the areas of transparent sheets 36, 36' and 36" mounted to corresponding frames 28, 28' and 28" are not involved in the projection of images.

Figure 7A:
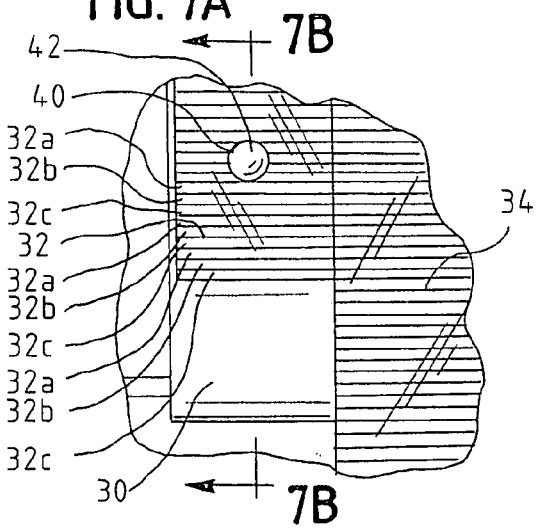
FIG. 7A is an enlarged fragmentary view of area C of FIG. 4.
Figure 7B:
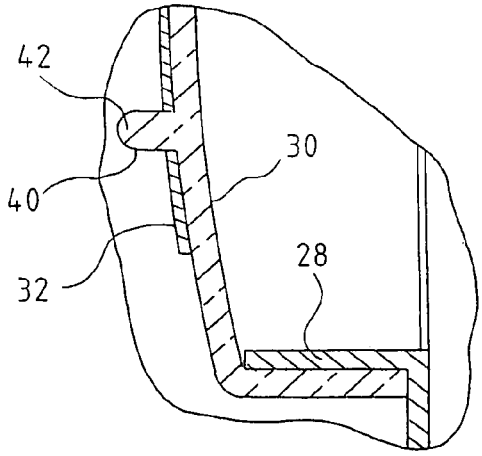
FIG. 7B is a sectional view along line 7B—7B of FIG. 7A.

FIGS. 4 and 5 show flexible image sheet 32 lying in surface contact with arcuate platen 30. FIGS. 7A and 7B (a sectional view along line 7—7 of FIG. 7A) are an expanded view of area C of FIG. 4 showing that image sheet 32 is fabricated to include pin openings 40 for pins 42 which are integral to platen 30. By placing pins 42 into openings 40, image sheet 32 is held firmly in place upon the arcuate surface of platen 30 as restricting layer 34 moves across the surface of image sheet 32 as will be explained more fully below. Pins 42 and openings 40 also prevent image sheet 32 from rippling or wrinkling—conditions that are deleterious to the projection of high resolution image display. Alternatively, image sheet 32 may be fabricated to extend to frame 28 so that image sheet 32 is attached to frame 28 in a similar manner.

Any suitable translucent flexible material may be used to form image sheet 32 including, but not limited to, Mylar. FIGS. 1–4 show image sheet 32 displaying an image of woman 15. Preferably, image sheet 32 contains a plurality of images. Most preferably, a plurality of parallel interleaved lines 32' form the plurality of images on sheet 32.

FIGS. 4 and 5 show restricting layer 34 overlying image sheet 32. Tension springs 44 provide a tensioning force on opposing edges of restricting layer 34 mounted thereto through holes 44' in restricting layer 34. Springs 44 are attached to corresponding opposing sides of frame 28 ensuring that restricting layer 34 maintains tensioned contact over the arcuate surface of image sheet 32 as a result of arcuate platen 30. Restricting layer 34 is formed from a flexible material and has transparent and opaque portions thereon. The opaque portions selectively prevent light from illumination source 24 from radiating through restricting layer 34. Only the portions of image sheet 32 that are in proper registration with the transparent portions of restricting layer 34 will be illuminated and therefore displayed. Preferably, the opaque portions are fine horizontal black lines 50 forming fine transparent lines therebetween the width of each corresponding to the interleaved image segments on image sheet 32. Hence, the backlit image of woman 15 in FIG. 4 is visible through the transparent portions of restricting layer 34 as opaque portions 50 block the display of all other images on image sheet 32.

Image sheet 32 and/or restricting layer 34 may be treated with a lubricant to reduce friction and concomitant surface wear. The skilled artisan will appreciate that the positions of image sheet 32 and restricting layer 34 may be switched without detracting from the scope of the present invention. In other words, restricting layer 34 may be attached to platen 30 and image sheet 32 may by placed in tensioned contact with restricting layer 34 as described above.

Mounted in module 14 is drive mechanism 46 having arm 48 that connects to restricting layer 34 as shown in FIG. 4. Drive mechanism 46 alters the alignment of restricting layer 34 relative to image sheet 32 and thereby changes the image displayed by device 10. The images on image sheet 32 may be arranged so that the movement of restricting layer 34 produces a sequential display of images, i.e., a simple animation. Electrical cord 18 supplies power to both drive mechanism 46 and illumination source 24 as shown in FIG. 5 and can be controlled by suitable switches (not shown).

Drive mechanism 46 may be a mechanical cam. Alternatively, drive mechanism 46 may include a programmable microprocessor that is coupled to and controls a suitable drive mechanism (not shown). As such, drive mechanism 46 may move restricting layer 34 up and down or left and right. A drive mechanism may be configured in a manner known to those skilled in the art to move restricting layer 34 in a pivoting motion, or circular motion in either clockwise or counterclockwise direction depending on the nature of the interleaved image.

In another variation, either image sheet 32 or restricting layer 34 may be incorporated into platen 30, such as disclosed in U.S. Pat. No. 4,118,879, for example, herein incorporated by reference. Drive mechanism 46 may also be provided as disclosed in U.S. Pat. No. 4,118,879. In the event image sheet 32 is incorporated into platen 30, restricting layer 34 may overlay platen 30 in tensioned contact as described above. Likewise, when restricting layer 34 is incorporated into platen 30, image sheet 32 may be placed in tensioned contact with platen 30. In both of these configurations, drive mechanism 46 may move the overlying sheet as described above. Obviously, pins 42 would not be necessary in these embodiments as no sheet is sandwiched between platen 30 and the sheet driven by drive mechanism 46.

Figure 8:
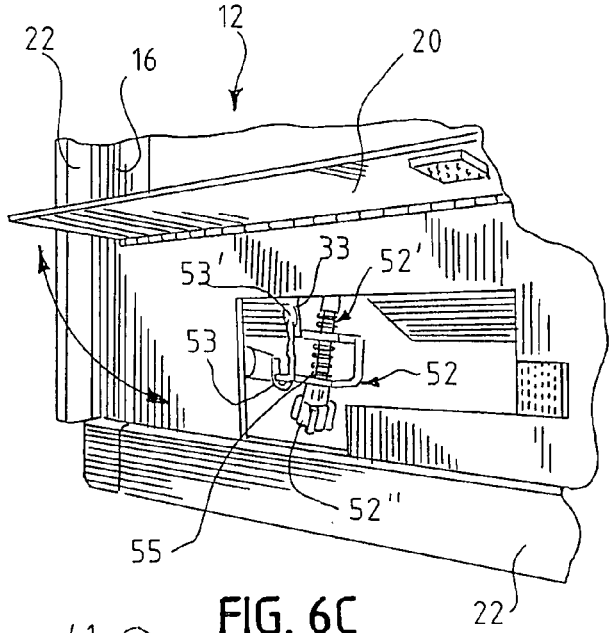
FIG. 8 is a fragmentary perspective view of a portion of the image display device of FIG. 1.

As shown in FIG. 8, an adjustment mechanism 52 controls the vertical tension on the left side of restricting layer 34 to provide an incremental vertical positioning adjustment of restricting layer 34. This provides an adjustment mechanism to allow proper registration of restricting layer 34 and image sheet 32. Mechanism 52 is accessible by simply lifting hinged panel 20 as shown in FIGS. 2 and 8. Mechanism 52 includes an adjustment threaded member 52' having a knob 52" that can be turned to increase or decrease tension on member 53 through bracket 55 which is in contact with member 53 and which moves up or down as member 52' is turned clockwise or counterclockwise to urge, or permit movement of, member 53 in a corresponding direction. Member 53 has a terminal end portion 53' that extends through a hole 33 in restricting layer 34 for exerting a downward force on layer 34. Increasing downward vertical tension on the left side of layer 34 moves the left side down and decreasing tension moves the left side up.

In a preferred embodiment, a horizontal registration strip extends across the upper and/or lower edge of image sheet 32 and in this case is composed of repeating lines 32*a–c* as shown in FIG. 7A. Preferably, the entire registration strip is about ⅜" to about ⅝" in width. The registration strip comprises a series of repeating elongated horizontal colored strips. Preferably, the number of colors corresponds to the number of interleaved images on image sheet 32. For example, an image sheet having interleaved images A, B and C would have a registration strip with a repeating sequence of three colored strips of desired color, such as image A corresponding to green, image B corresponding to red and image C corresponding to yellow. The colored horizontal lines of the registration strip would appear as a sequence of green, red, yellow, green, red, yellow, etc. One of ordinary skill in the art will realize that any color combination or contrast may be used for the registration strip as desired.

More specifically, image sheet 32 includes along either a top or a bottom portion thereof a plurality of thin different color horizontal registration indicia lines 32*a*, 32*b*, and 32*c* that repeat in sequence. Lines 32*a*, 32*b*, and 32*c* are parallel to lines 32' that form the images contained on image sheet 32. Lines 32*a*, 32*b*, and 32*c* are each of the same height and preferably extend across the entire width of a substantial portion of the width of image sheet 32. The height of lines 32*a*, 32*b*, and 32*c* is equal to, or slightly greater than, (about 1%) the height of the transparent lines of restricting layer 34. Lines 32*a*, 32*b*, and 32*c* are located on image sheet 32 so that when image sheet 32 is adjusted relative to restricting layer 34, registration indicia lines 32*a*, 32*b*, and 32*c* are parallel to the transparent lines of restricting layer 34 and are located at a proper vertical orientation so that image layer or sheet 32 is in proper registry relative to restricting layer or sheet 34 (proper horizontal and vertical orientation being proper registry). When image layer or sheet 32 and restricting layer or sheet 34 are in proper registry, only one type of lines 32*a*, 32*b*, and 32*c* are visible (e.g., only lines 32*a*, only lines 32*b* or only lines 32*c*).

Precise parallel alignment between restricting layer 34 and the interleaved strips 32' of image sheet 32 occurs by dialing knob 52 so that restricting layer 34 blocks all but one color in the registration strip. For example, when registration strip shows a series of only green horizontal lines this indicates that restricting layer 34 is properly aligned with image A. Obviously, if one image is properly aligned, restricting layer 34 is properly aligned with all the interleaved images as the interleaved image strips are parallel to one another. Of course, the registration strip is not visible during normal display of images on device 10 since the bottom of image sheet 32 is covered by a portion of frame 16.

In a preferred embodiment, the width of the individual colored strips of the registration strip is equal to or slightly greater than the width of the transparent sections of restricting layer 34.

The width of horizontal lines 50 and/or the width of the interleaved image strips 32' may be different for different image sheets, for example, due to the size of the overall display, the number of images interleaved upon image sheet 32 or combinations of both or as desired. For example, in one embodiment the width of lines 50 and/or image strips 32' may range anywhere from about 5 lines per inch to about 50 lines per inch. Image sheets and restricting layers having a line density of from about 10 lines per inch to about 25 lines per inch are preferred. The skilled artisan will realize that "lines per inch" includes the total number of transparent, colored or opaque horizontal lines/strips as well as any combinations thereof on an inch of height (for vertical movement) or width (for horizontal movement) for either the image sheet or the restricting layer.

In one embodiment, an image sheet has four interleaved images thereon in an arrangement of 15 lines per inch with each individual interleaved strip being $1/15^{th}$ of an inch. The restricting layer likewise has an arrangement of 15 lines per inch with each line having a width of $1/15^{th}$ of an inch. As three of the four images are blocked from view at any given time, three consecutive lines on the restricting layer are opaque. A transparent line subsequently follows. This sequence repeats for the entire restricting layer—i.e., three opaque lines, one transparent line; three opaque lines, one transparent line, etc. Alignment vis-à-vis the registration strip as previously described ensures that each of the four images is independently displayed as the restricting layer moves about the image layer.

The number of interleaved images on the image sheet and the line concentration for the image sheet and the restricting layer may be varied as desired. For example, an image sheet may have three interleaved images with a line density of 10 lines per inch. A corresponding restricting layer, with the same line density of 10 lines per inch, would have a repeating sequence of two consecutive opaque lines followed by one transparent line. This arrangement of opaque and transparent lines on the restricting layer blocks two images and displays one image of the image sheet at any given instant. Similarly, in another embodiment the image sheet may have five interleaved images with a line density of 25 lines per inch. A corresponding 25 line per inch restricting layer would then have a repeating sequence of four consecutive opaque lines followed by a transparent line. In either of these embodiments, the registration strip may be used to ensure proper alignment as previously described.

Upper trough 54 and lower plate 56 on the outer edges of module 14 allow easy installation of module 14 in housing 12 as shown in FIG. 5. Trough 54 and plate 56 also enable module 14 to be retrofitted into older display devices that previously housed static image displays. Consequently, module 14 may be adapted to have its own illumination source.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

I claim:

1. An apparatus for displaying images comprising:

a frame;

a transparent, flexible sheet of material mounted to the frame in compression to form an arcuate-shaped platen, said transparent, flexible sheet of material comprising first and second opposed ends and first and second peripheral flanges extending respectively from said opposed ends;

a flexible image sheet having translucent images thereon associated with the arcuate-shaped platen;

a restricting layer having transparent and opaque portions associated with said image sheet to permit viewing of those portions of the image sheet that register with the transparent portions of the restricting layer.

2. The apparatus of claim 1 wherein the first and second flanges are mounted to the frame to place the transparent, flexible sheet in compression to form the arcuate-shaped platen.

3. The apparatus of claim 1 wherein non-viewing margin areas of said transparent, flexible sheet of material are secured to the frame.

4. The apparatus of claim 1 wherein the arcuate platen is convex adjacent the flexible image sheet.

5. The apparatus of claim 1 wherein the transparent flexible sheet of material is mounted to a curved frame to form the arcuate platen.

6. The apparatus of claim 5 wherein the curved frame comprises spaced apart first and second arcuate segments that contact non-viewing margin areas of said sheet of material.

7. The apparatus of claim 6 wherein the arcuate segments each have a curvature that corresponds to the curvature of the platen.

8. The apparatus of claim 1 wherein said restricting layer is in tensioned contact with the image sheet.

9. The apparatus of claim 1 further comprising a drive mechanism for relative shifting of the restricting layer in front of the image sheet.

10. The apparatus of claim 9 further comprising a first housing for containing the frame, the platen, the flexible image sheet, the restricting layer and the drive mechanism.

11. The apparatus of claim 10 further comprising a source of illumination for illuminating the flexible image sheet.

12. The apparatus of claim 11 wherein the source of illumination is located within a second housing that contains the first housing.

13. The apparatus of claim 1 wherein the transparent, flexible sheet is composed of acrylic resin.

14. The apparatus of claim 1 wherein the transparent flexible sheet is normally flat when not in compression.

15. The apparatus of claim 1 wherein the arcuate-shaped platen is bow-shaped.

16. The apparatus of claim 1 wherein said image sheet is incorporated into said platen.

17. The apparatus of claim 16 wherein said restricting layer is in tensioned contact with said platen.

18. The apparatus of claim 17 further comprising a drive mechanism for relative shifting of the restricting layer in front of said platen.

19. The apparatus of claim 1 wherein said image sheet comprises a registration strip for registering said image sheet relative to said restricting layer.

20. The apparatus of claim 19 wherein said registration strip further comprises a plurality of thin horizontal colored lines arranged in a repeating color sequence, wherein each individual line is about as vide as said transparent portions.

21. The apparatus of claim 20 wherein each individual line is slightly thicker than said transparent portions.

22. The apparatus of claim 19 wherein said registration strip has a width and said image sheet further comprises a plurality of interleaved strips, each of said interleaved strips having a width substantially equal to the of said registration strip.

23. The apparatus of claim 22 wherein the width of each said interleaved strip is in the range of about $1/10^{th}$ of an inch to about $1/25^{th}$ of an inch.

24. The apparatus of claim 1 wherein said restricting layer is incorporated into said platen.

25. The apparatus of claim 24 wherein said image sheet is in tensioned contact with said platen.

26. The apparatus of claim 25 further comprising a drive mechanism for relative shifting of the image sheet in front of said platen.

27. The apparatus of claim 1 wherein said image sheet is in tensioned contact with said platen.

28. A method of forming an arcuate transparent platen in an animated display device that includes a frame, the arcuate platen, a flexible image sheet having translucent images thereon associated with the arcuate-shaped platen, a restricting layer associated with said image sheet and having transparent and opaque portions to permit viewing of those portions of the image sheet that register with the transparent portions of the layer, comprising:

compressing a flexible sheet of transparent material having first and second opposed ends: and mounting said opposed ends of the flexible sheet of transparent material to the frame with said flexible sheet of transparent material in compression to form an arcuate platen.

29. The method of claim 28 wherein the shape of the arcuate platen is bow-shaped.

30. An apparatus for displaying images comprising:

a frame;

a transparent, flexible sheet of material mounted to the frame to form an arcuate platen;

a flexible image sheet having translucent images thereon associated with the arcuate-shaped platen;

a restricting layer having transparent and opaque portions associated with said image sheet to permit viewing of those portions of the image sheet that register with the transparent portions of the restricting layer, said image sheet further comprising a registration strip for registering said image sheet relative to said restricting layer.

31. The apparatus of claim 30 wherein said registration strip further comprises a plurality of thin horizontal colored lines arranged in a repeating color sequence, wherein each individual line is about as wide as said transparent portions.

32. The apparatus of claim 31 wherein each individual line is slightly thicker than said transparent portions.

33. The apparatus of claim 30 wherein said registration strip has a width and said image sheet further comprises a plurality of interleaved strips, each of said interleaved strips having a width substantially equal to the width of said registration strip.

34. The apparatus of claim 33 wherein the width of each of said interleaved strips is in the range of about $1/10^{th}$ of an inch to about $1/25^{th}$ of an inch.

* * * * *